US006739669B2

(12) United States Patent
Etzioni et al.

(10) Patent No.: US 6,739,669 B2
(45) Date of Patent: May 25, 2004

(54) FOLDABLE ARMREST FOR A SEAT HAVING A COLLAPSIBLE BACK

(75) Inventors: Yoel Etzioni, Kibbutz Tzora (IL); Aharon Nadler, Kibbutz Tzora (IL); Amit Avigdor, Zur-Igal (IL); Doron Krom, Kibbutz Gal-ed (IL)

(73) Assignee: Tzora Active Systems Ltd., Kibbutz Tzora (IL)

( * ) Notice: Subject to any disclaimer, the term of this patent is extended or adjusted under 35 U.S.C. 154(b) by 0 days.

(21) Appl. No.: 10/155,863

(22) Filed: May 23, 2002

(65) Prior Publication Data

US 2003/0218373 A1 Nov. 27, 2003

(51) Int. Cl.[7] ..... A47C 7/54

(52) U.S. Cl. ..... 297/411.32; 297/411.44; 297/378.1

(58) Field of Search ..... 297/411.2, 411.3, 297/411.32, 411.33, 411.38, 411.35, 411.39, 411.44, 378.1

(56) References Cited

U.S. PATENT DOCUMENTS 1,291,413 A * 1/1919 Cluff, Jr.
2,689,600 A * 9/1954 Van Briesen
3,661,421 A * 5/1972 Johnson
3,806,192 A * 4/1974 Ohlrogge et al.
4,097,088 A * 6/1978 Meiller
4,307,913 A * 12/1981 Spiegelhoff
4,639,012 A * 1/1987 Jensen
4,887,866 A * 12/1989 Rusin
6,341,821 B1 * 1/2002 Rousseau

* cited by examiner

*Primary Examiner*—Milton Nelson, Jr.
(74) *Attorney, Agent, or Firm*—Ladas & Parry

(57) ABSTRACT

A foldable armrest unit for a seat having a collapsible seat back, including an armrest one end of which is articulated to first joint device affixed to a lateral surface of the seat back, the armrest unit further including an armrest support member, one end of which is articulated to the armrest and the other end of which is articulated to second joint device affixed to a lateral surface of the seat; the armrest having three limit positions: a first limit position being the position of use, in which the seat back is in an upright position and the armrest is in a substantially horizontal position; a second limit position in which the seat back is still in the upright position, while the armrest is swung towards the seat back to facilitate access to and egress from the seat, and a third limit position in which the armrest is completely folded down, together with the collapsed seat back.

13 Claims, 4 Drawing Sheets

FOLDABLE ARMREST FOR A SEAT HAVING A COLLAPSIBLE BACK

FIELD OF THE INVENTION

The present invention relates to a foldable armrest unit for a seat having a collapsible back.

BACKGROUND OF THE INVENTION

Seats having collapsible backs are used in small powered vehicles for the elderly or handicapped, and may be folded for storage. In the past, such seats had armrests that had to be dismounted prior to folding or storing and remounted prior to use. In other types of seats the armrest or armrests had to be lifted or lowered for seat access independent of seat folding.

DISCLOSURE OF THE INVENTION

It is thus one of the objects of the present invention to provide an armrest unit that is an integral part of the seat, will automatically fold down when the seat back is collapsed, and will be restored to its working position when the seat back is raised.

It is a further object of the present invention to provide an armrest unit that can be swung out of the way to facilitate comfortable access to and egress from the seat.

It is yet another object of the present invention to provide means for preventing pressure exerted on the armrest unit from inadvertently initiating collapse of the seat back.

According to the invention, the above objects are achieved by providing a foldable armrest unit for a seat having a collapsible seat back, comprising an armrest, one end of which is articulated to first joint means affixed to a lateral surface of the seat back, comprising an armrest support member, one end of which is articulated to the armrest and the other end of which is articulated to second joint means affixed to a lateral surface of the seat; the armrest having three limit positions: a first limit position being the position of use, in which the seat back is in an upright position and the armrest is in a substantially horizontal position; a second limit position in which the seat back is still in the upright position, while the armrest is swung towards the seat back to facilitate access to and from the seat, and a third limit position in which the armrest is completely folded down, together with the collapsed seat back.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 illustrates the armrest unit according to the present invention, in its first limit position;

FIG. 2 illustrates the armrest unit in its second limit position;

FIG. 3 illustrates the armrest unit in its third limit position;

FIG. 4 is a partial cross-sectional view of the armrest of the invention;

FIG. 5 is a cross-sectional view along plane V—V of FIG. 4;

Figure 4:
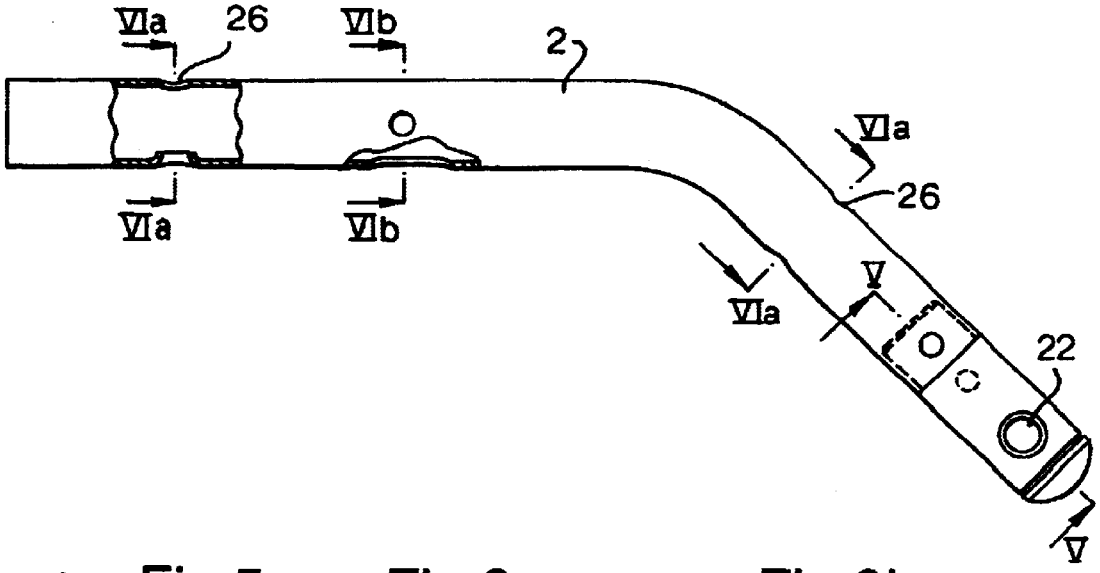
Figure 6A:
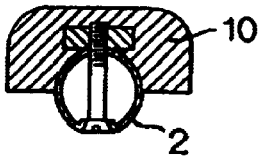
Figure 6B:
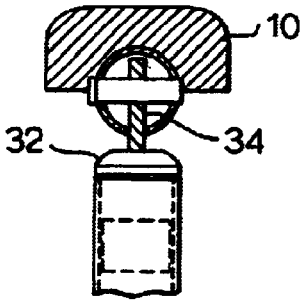
Figure 7:
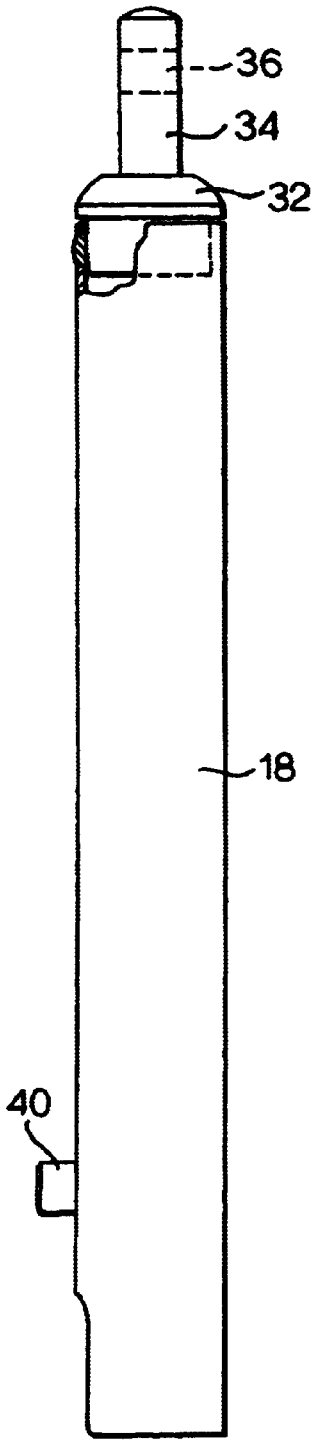
Figure 8:
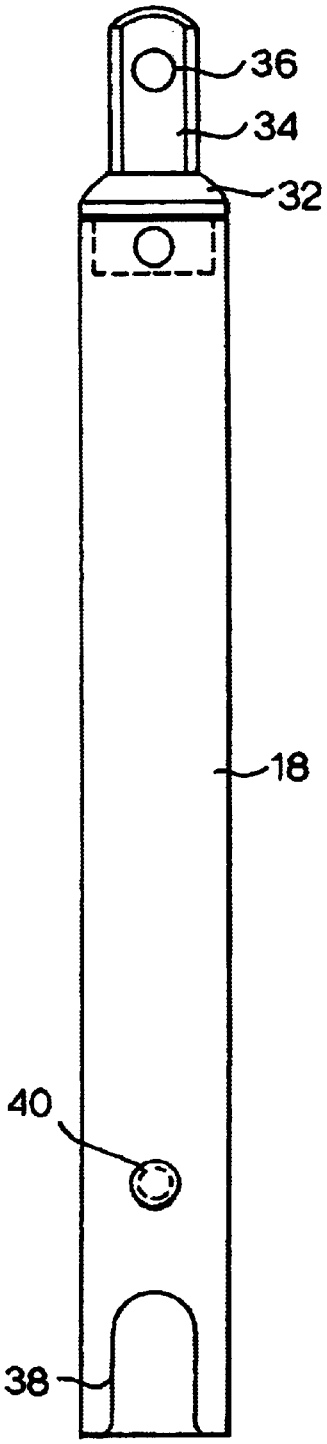
Figure 9:
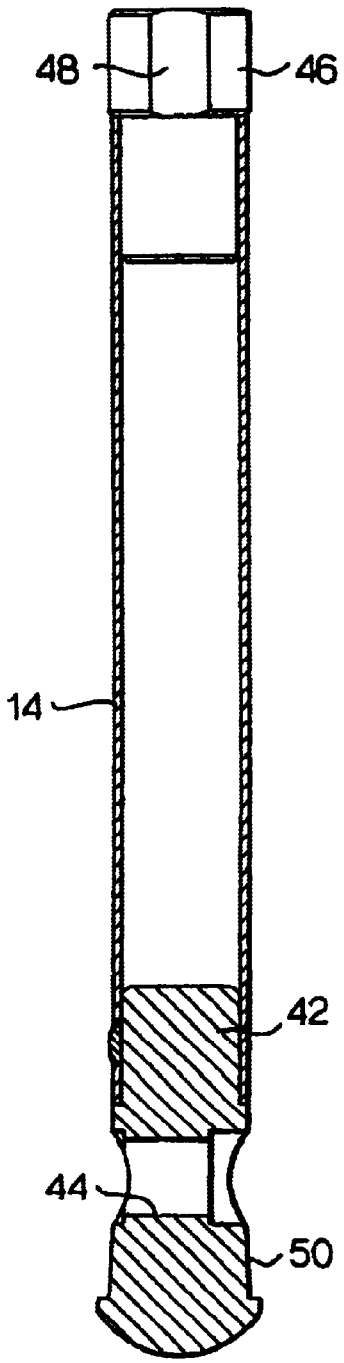
Figure 10:
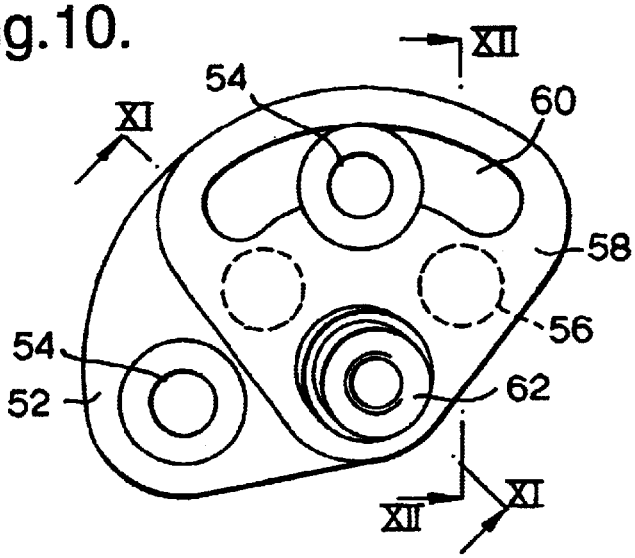
Figure 11:
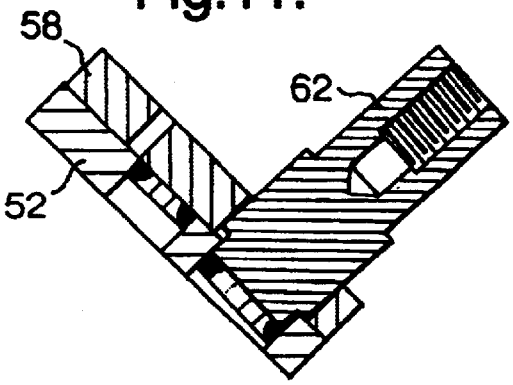
Figure 12:
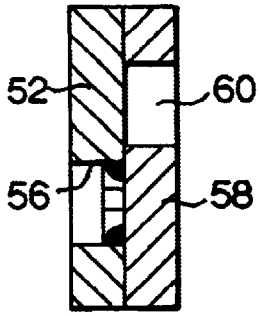
Figure 13:
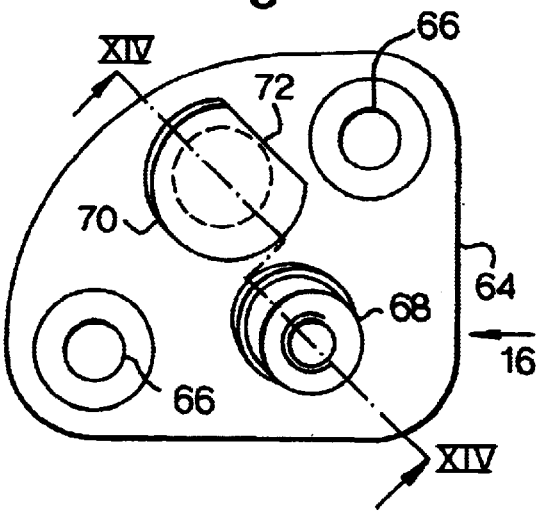

FIGS. 6*a* and 6*b* are cross-sectional views along planes VIa and VIb, respectively, of FIG. 4;

FIGS. 7 and 8 represent two views of the outer telescoping tube of the armrest support member;

FIG. 9 is a cross-sectional view of the inner telescoping tube of the armrest support member;

FIG. 10 represents a front view of the upper joint of the armrest;

FIG. 11 is a cross-sectional view along plane XI—XI of FIG. 10;

FIG. 12 is a front view of the upper joint of the armrest;

FIG. 13 is a front view of the lower joint of the armrest, and

Figure 14:
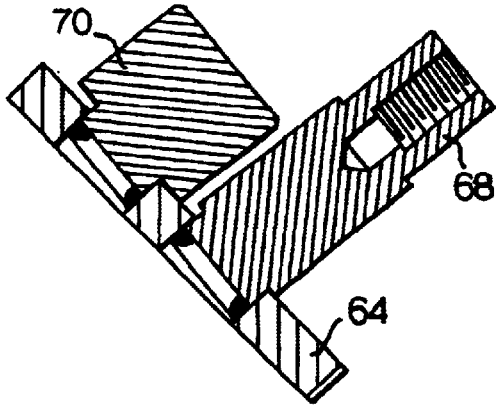

FIG. 14 is a cross-sectional view along plane XIV—XIV of FIG. 13.

DETAILED DESCRIPTION

Figure 1:
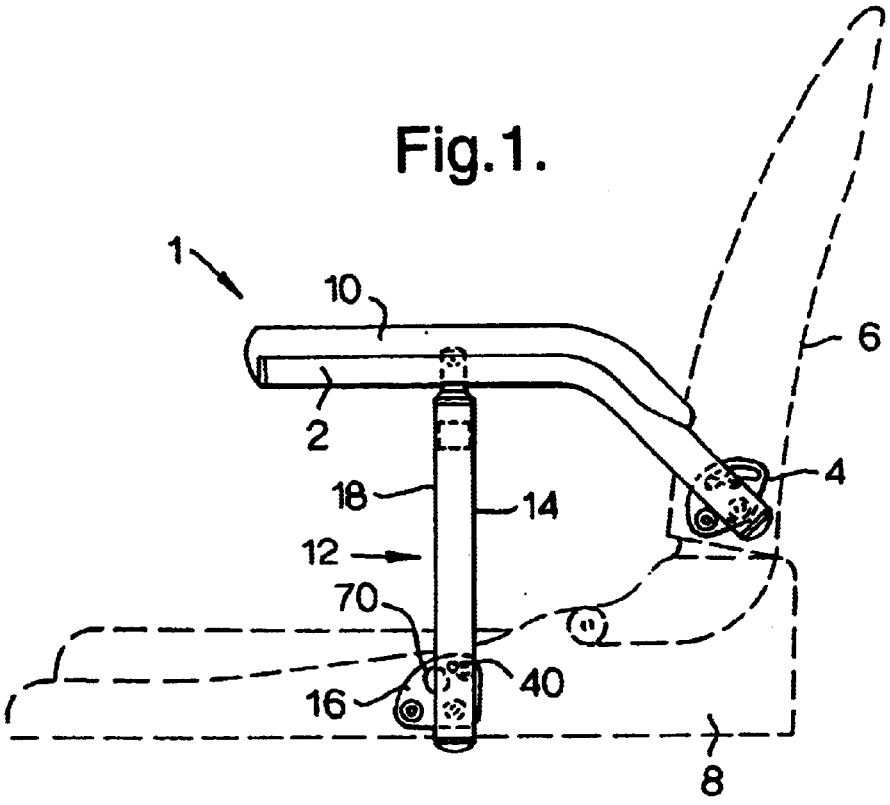

Referring now to the drawings, there is shown in FIG. 1 an armrest unit 1, comprising an armrest 2, articulated to an upper joint 4 fixedly attached to a lateral surface of the collapsible back 6 of a seat 8. Armrest 2 is also provided with padding 10.

Figure 2:
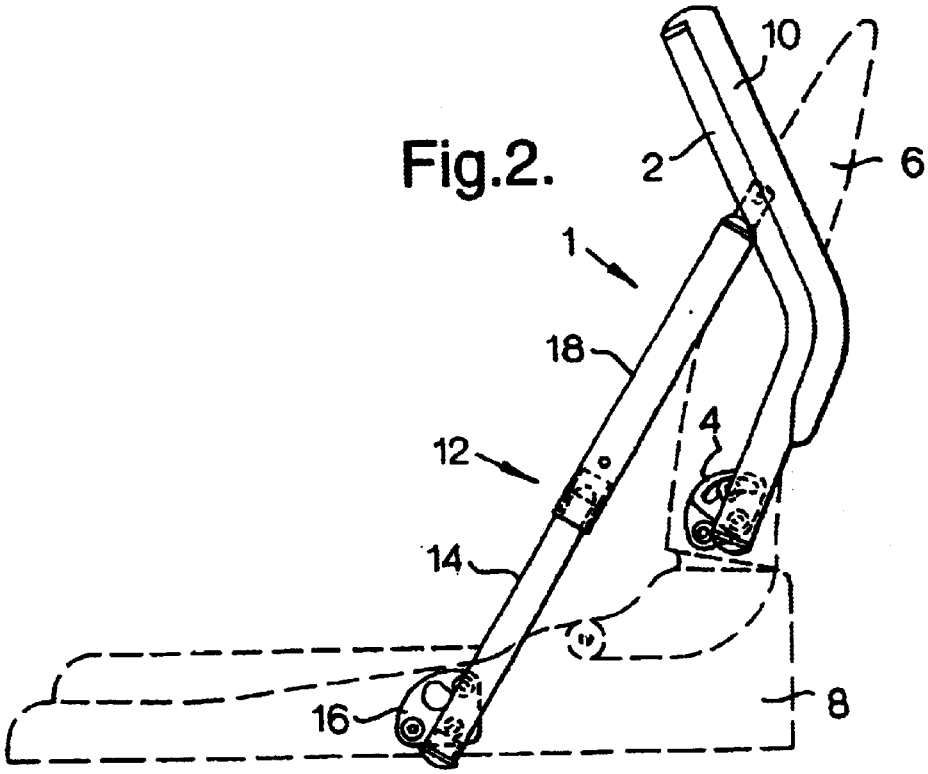

Further shown is a support member 12, which, as seen to better effect in FIG. 2, consists of two telescoping tubular elements: an inner tube 14, the lower end of which is articulated to a lower joint 16 fixedly attached to a lateral surface of seat 8, and an outer tube 18, the upper end of which is articulated to armrest 2. FIG. 1 shows the armrest according to the invention in the first of three limit positions, which is the position in which the seat is used.

FIG. 2 shows the armrest 2 in its second limit position, in which support member 12 is swung back towards seat back 6 to facilitate access to and egress from the seat 8. It is clearly seen that the change of length of support member 12, involved in the movement of armrest 2 from the position shown in FIG. 1 to that shown in FIG. 2 and back again, is accommodated by the relative movement of telescoping tubes 14 and 18. Once seated, the user pushes the raised armrest 2 back to the position illustrated in FIG. 1.

Figure 3:
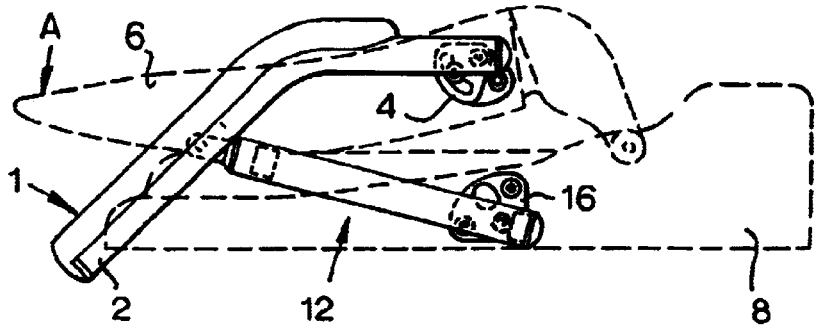

FIG. 3 illustrates the third limit position of armrest 2, arrived at when seat back 6 is collapsed by pushing it in the direction of arrow A, automatically causing the armrest 2 to fold and assume the position shown. Obviously, pulling the collapsed seat back 6 in the opposite direction will re-erect it and will also automatically restore armrest 2 to the position shown in FIG. 1.

Figure 5:
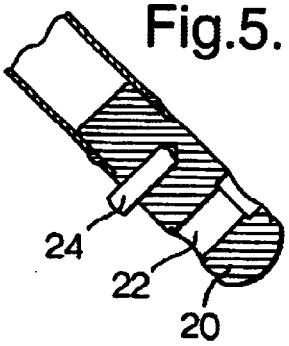

FIGS. 4 and 5 illustrate armrest 2, which has the form of a tubular member having a bent end portion to which is welded a solid end piece 20 with a countersunk bore 22, whereby armrest 2 is articulated to a pivot provided on upper joint 4 (FIG. 10). Also seen is a pin 24 projecting from end piece 20. In the assembled state of armrest 2, pin 24 projects into an annular recess of limited angular extent provided in upper joint 4 (FIG. 10), constituting a stop limiting the folding and unfolding movement of the armrest.

Further shown are diametral holes 26, serving screws for affixing the padding 10. Another diametral hole 28 and an elongated opening 30 serve for the articulation of the upper end of outer telescoping tube 18.

FIGS. 6*a* and 6*b* are cross-sectional views of padding 10, attached to armrest 2 by means of screws.

FIGS. 7 and 8 depict the outer telescoping tube 18. Seen is a head piece 32 welded to tube 18 and provided with a flat nose 34 which, in assembly, enters armrest 2 through elongated opening 30 (FIG. 1) and is articulated to armrest 2 by means of a pivot (not shown) passing through holes 36 and 28 (FIG. 4). The lower end of tube 18 is provided with a slot 38 which can slip freely over the pivot in lower joint 16. Also seen is a pin 40, the purpose of which will be discussed below in conjunction with FIG. 13.

FIG. 9 represents inner telescoping tube 14, which is seen to have a lower, metallic end piece 42 welded to tube 14 and provided with a countersunk bore 44, whereby inner tube 14 is articulated to a pivot provided on lower joint 16 (FIG. 14). The upper end of tube 14 is provided with a plug 46, slidingly fitting the inside diameter of outer telescoping tube 18 and advantageously made of one of the low-friction plastics. Two oppositely located slots 48 cut in plug 46 permit the passage of air during the folding and unfolding movements of armrest 2. To ensure a smooth, substantially free fit between tubes 14 and 18 in their fully telescoped position, the end portion 50 of end piece 42 is slightly tapered, ensuring the lateral stability of the armrest in its position of use.

FIGS. 10 to 12 represent the upper joint 4, which is seen to comprise a base plate 52 affixed to a lateral surface of seat back 6 by means of screws passing through countersunk holes 54. A top plate 58, provided with an annular recess 60 of a limited angular extent, is welded to base plate 52 through holes 56. In assembly, pin 24 of armrest 2 (FIG. 5) projects into recess 60, whereby the folding and unfolding movements of armrest 2 are delimited. Also welded to base plate 52 is pivot 62, on which armrest 2 is mounted and swivels, retained by a screw (not shown). It will be appreciated that pivot 62 with base 52 includes an angle larger than 90°, to compensate for the draft of the lateral surfaces of the plastic molding of seat back 6.

FIGS. 13 and 14 represent lower joint 16, which is seen to comprise a base plate 64, countersunk holes 66 for screws (not shown), and a pivot 68 welded to base plate 64. Inner telescoping tube 14 (FIG. 1) is mounted on and swivels about pivot 68, retained by a screw (not shown). Also welded to base plate 64 is an abutment member 70 having a substantially planar surface 72 which, in assembly, is inclined with respect to the general plane of seat 8 but is substantially perpendicular to the lateral surface on which joint 16 is mounted. This inclined surface cooperates with pin 40 of outer telescoping tube 18 (FIGS. 1, 7) to the effect of preventing the collapse of seat back 6 upon the application of pressure to armrest 2, but allowing pin 40 to ride along planar surface 72, facilitating such collapsing when a tilting force is applied to seat back 6.

Pivot 68 and abutment member 70, with lower joint 16 and base plate 64, include an angle larger than 90°, for the same reason given above with regard to upper joint 4.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A foldable armrest unit attached to a seat having a collapsible seat back, comprising:

an armrest, one end of which is articulated to first joint means affixed to a lateral surface of said seat back;

an armrest support member, one end of which is articulated to said armrest and the other end of which is articulated to second joint means affixed to a lateral surface of said seat;

said armrest has three limit positions: a first limit position being the position of use, in which said seat back is in an upright position and said armrest is in a substantially horizontal position; a second limit position in which said seat back is still in the upright position, while said armrest is swung towards said seat back to facilitate access to, and egress from, said seat, and a third limit position in which said armrest is completely folded down, together with the collapsed seat back and wherein said armrest support member is constituted by a pair of telescoping tubes accommodating the change of length of said support member involved in the movement of said armrest from said first limit position to said second limit position and back again, one of said telescoping tubes being articulated to said armrest and the other being articulated to said seat.

2. The armrest unit attached to the seat as claimed in claim 1, wherein one end of the armrest support member is connected to the armrest around a middle section of the armrest.

3. The armrest unit attached to the seat as claimed in claim 1, further comprising a pin fixedly attached to the outer one of said telescoping tubes, said pin cooperating with abutment means stationary relative to said seat to prevent the initiation of collapse of said seat back by the application of pressure on said armrest.

4. The armrest unit attached to the seat as claimed in claim 3, wherein said abutment means comprises a member fixedly attached to said second joint means and provided with a substantially planar surface inclined with respect to the general plane of said seat, but substantially perpendicular to the lateral surface thereof, said inclined surface cooperating with said pin to prevent the collapse of said seat back upon the application of pressure to said armrest but permitting such collapse when a tilting force is applied to said seat back.

5. The armrest unit attached to the seat as claimed in claim 1, wherein said first and second joint means are each provided with a pivot about which said armrest and said support member are respectively adapted to swivel.

6. The armrest unit attached to the seat as claimed in claim 5, wherein said pivots include, along with bases of their respective joint means, angles larger than 90 °.

7. A foldable armrest unit for use with a chair having a seat and a collapsible seat back, the armrest unit comprising:

an armrest, one end of which is articulated to first joint means adapted to be affixed to a lateral surface of said seat back;

an armrest support member, one end of which is articulated to said armrest and the other end of which is articulated to second joint means adapted to be affixed to a lateral surface of said seat;

wherein one end of the armrest support member is connected to the armrest around a middle section of the armrest; and wherein said armrest has three limit positions: a first limit position being the position of use, in which said seat back is in an upright position and said armrest is in a substantially horizontal position; a second limit position in which said seat back is still in the upright position, while said armrest is swung towards said seat back to facilitate access to, and egress from said seat, and a third limit position in which said armrest is completely folded down, together with the collapsed seat back.

8. A foldable armrest unit for use with a chair having a seat and a collapsible seat back, the armrest unit comprising:

an armrest, one end of which is articulated to first joint means adapted to be affixed to a lateral surface of said seat back;

an armrest support member, one end of which is articulated to said armrest and the other end of which is articulated to second joint means adapted to be affixed to a lateral surface of said seat; wherein said armrest support member is constituted by a pair of telescoping tubes accommodating the change of length of said support member adapted to movements of said armrest, wherein one of said telescoping tubes is adapted to be connected to said armrest, and the other is adapted to be connected to said seat; and wherein said armrest has three limit positions: a first limit position being the position of use, in which said seat back is in an upright position and said armrest is in a substantially horizontal position; a second limit position in which said seat back is still in the upright position, while said armrest is swung towards said seat back to facilitate access to, and egress from, said seat, and a third limit position in which said armrest is completely folded down, together with the collapsed seat back.

9. The armrest unit as claimed in claim 8, wherein one end of the armrest support member is connected to the armrest around a middle section of the armrest.

10. The armrest unit as claimed in claim 8, further comprising a pin fixedly attached to the outer one of said telescoping tubes, said pin engagable with abutment means stationary relative to said pin to prevent the initiation of collapse of said armrest by application of pressure on said armrest.

11. The armrest unit as claimed in claim 8, wherein said first and second joint means are each provided with a pivot about which said armrest and said support member are respectively adapted to swivel.

12. The armrest unit as claimed in claim 11, wherein said pivots include, along with bases of their respective joint means, angles larger than 90 °.

13. A foldable armrest unit attached to a seat having a collapsible back, comprising:

an armrest, one end of which is articulated to first joint means affixed to a lateral surface of said seat back;

an armrest support member, one end of which is articulated to said armrest and the other end of which is articulated to second joint means affixed to a lateral surface of said seat;

wherein one end of the armrest support member is connected to the armrest around a middle section of the armrest; and wherein said armrest has three limit positions: a first limit position being the position of use, in which said seat back is in an upright position and said armrest is in a substantially horizontal position; a second limit position in which said seat back is still in the upright position, while said armrest is swung towards said seat back to facilitate access to, and egress from, said seat, and a third limit position in which said armrest is completely folded down, together with the collapsed seat back.

* * * * *